US008372222B2

(12) United States Patent
Pfaffmann et al.

(10) Patent No.: US 8,372,222 B2
(45) Date of Patent: Feb. 12, 2013

(54) METHOD OF PRODUCING LOCALLY AUSTEMPERED DUCTILE IRON

(75) Inventors: George D. Pfaffmann, Farmington Hills, MI (US); John R. Keough, Ann Arbor, MI (US); Robert J. Madeira, Commerce Township, MI (US); Christopher Allen Bixler, Ypsilanti, MI (US)

(73) Assignee: Ajax Tocco Magnethermic Corporation, Warren, OH (US)

( * ) Notice: Subject to any disclaimer, the term of this patent is extended or adjusted under 35 U.S.C. 154(b) by 281 days.

(21) Appl. No.: 12/572,828

(22) Filed: Oct. 2, 2009

(65) Prior Publication Data

US 2010/0084059 A1 Apr. 8, 2010

Related U.S. Application Data

(60) Provisional application No. 61/195,131, filed on Oct. 3, 2008.

(51) Int. Cl.
*C21D 1/42* (2006.01)
*C21D 1/10* (2006.01)
*C21D 11/00* (2006.01)

(52) U.S. Cl. ..... 148/639; 148/511; 148/526; 148/567; 148/644; 148/663

(58) Field of Classification Search ..... 148/500, 148/503–508, 511, 639, 643, 644, 526, 567, 148/569–575, 663
See application file for complete search history.

(56) References Cited

U.S. PATENT DOCUMENTS

| | | | | |
|---|---|---|---|---|
| 4,637,844 | A | 1/1987 | Pfaffmann | |
| 4,715,907 | A * | 12/1987 | Pfaffmann | 148/573 |
| 4,880,477 | A * | 11/1989 | Hayes et al. | 148/545 |
| 5,028,281 | A | 7/1991 | Hayes et al. | |
| 5,753,055 | A * | 5/1998 | Liu | 148/545 |
| 5,837,069 | A * | 11/1998 | Deards et al. | 148/323 |
| 2006/0213588 | A1 * | 9/2006 | Fujita et al. | 148/511 |

FOREIGN PATENT DOCUMENTS

| | | |
|---|---|---|
| JP | 363259017 | * 10/1988 |
| JP | 03013522 | * 1/1991 |

* cited by examiner

*Primary Examiner* — Deborah Yee
(74) *Attorney, Agent, or Firm* — Sand & Sebolt

(57) ABSTRACT

A system and method for producing locally austempered ductile iron includes a computer program for closely controlling the heating and cooling of an iron part or workpiece. The process allows for the austempering of a relatively low cost iron workpiece to produce significantly higher quality end products. The locally austempered regions may be formed to a substantial controlled depth.

33 Claims, 6 Drawing Sheets

METHOD OF PRODUCING LOCALLY AUSTEMPERED DUCTILE IRON

CROSS REFERENCE TO RELATED APPLICATIONS

This application claims priority from U.S. Provisional Application Ser. No. 61/195,131 filed Oct. 3, 2008; the disclosure of which is incorporated herein by reference.

BACKGROUND OF THE INVENTION

1. Technical Field

The present invention relates generally to austempered ductile iron (ADI) and an apparatus and method of forming the same. More particularly, the present invention relates to the localized formation of ADI. Specifically, the invention relates to a product having localized ADI, and the apparatus and method for controlling the heating and cooling of the item on which the localized ADI is formed.

2. Background Information

Austempering of ductile iron increases its hardness, abrasion resistance, ductility, toughness and fatigue resistance among other things. The ADI process has been used in the production of a wide variety of components, for instance, engine components such as crankshafts, camshafts, connecting rods; chassis components such as brackets, arms and knuckles; power train/drive line components such as gears, shafts, carrier housings and clutches, ring gears and pinions, and other gears as well; structural components such as brackets, side beams, rollers and so forth; and other wear components in various other applications. Generally, an iron part or a portion thereof is heated to an austenitizing temperature to transform it to austenite and to allow diffusion of carbon into the metal matrix of the ductile iron. The part is cooled from the austenitizing temperature at a rate sufficient to avoid formation of pearlite to a temperature above the martensite transformation temperature. The part is maintained at this target isothermal transformation temperature range for a time sufficient to form a metal matrix consisting primarily of ausferrite. Ausferrite is a matrix of acicular ferrite and carbon stabilized austenite, the latter also known as high carbon austenite. The rapid quenching and holding of the part at the transformation temperature range for a suitable period provides for the formation of ausferrite without the formation of pearlite or martensite.

This process has been performed by heating the entire part to the austenitizing temperature, as disclosed in U.S. Pat. No. 4,637,844 to Pfaffmann, and has also been performed selectively heating eccentric lobes of a camshaft to the austenitizing temperature while the remainder of the camshaft is not heated to this temperature, as disclosed in U.S. Pat. No. 5,028,281 to Hayes et al. In the latter process, only surface portions of the lobes are austenitized while the rest of the camshaft remains in a non-austempered condition. Hayes also indicates that the camshaft is quenched in a salt bath, which may include a mixture of sodium nitrite, sodium nitrate and potassium nitrate, to decrease the temperature rapidly enough to avoid the pearlite range, or alternately in a quench medium which may comprise an oil or a fluidized bed, the fluidized bed preferably including a heated granular solid medium having a gas such as air blowing through the medium. Another method, disclosed in U.S. Pat. No. 5,064,478 granted to Kovacs et al., includes uniformly heating the surface of a part by immersion in a molten metallic bath to form a desired thickness of surface austenite and thereafter quenching the heated cast iron part in a liquid quenching bath maintained at a temperature between 450° to 800° F. The Kovacs process does not allow for a specific localized hardening, but rather a hardening of the entire outer surface of the part.

These methods, as well as others, can require significant, expensive alloying or prior heat treatment of the ductile iron to achieve their purpose. Some of the alloying metals typically used are copper, nickel and molybdenum. For instance, these metals are generally added to provide sufficient hardenability for flame-based surface austempering processes. In addition, quenching baths such as a heated salt bath or oil bath may present health hazards or environmental hazards due to evaporation. Even lead baths have been used. Immersion of a part in a salt bath also requires the subsequent rinsing of the bath solution from the part. Immersion in a metallic molten bath (as in the method of Kovacs et al. noted above) is a relatively costly way of heating the part.

While the process of austempering, including surface austempering, is generally known, there still remains room for improvement in the formation of optimum metallurgical microstructures. In addition, there is a need for a more robust and cost effective method of locally austempering. The present invention addresses problems with the current art and provides an improved alternative.

BRIEF DESCRIPTION OF THE SEVERAL VIEWS OF THE DRAWINGS

Similar numbers refer to similar parts throughout the drawings.

DETAILED DESCRIPTION OF THE INVENTION

Figure 1:
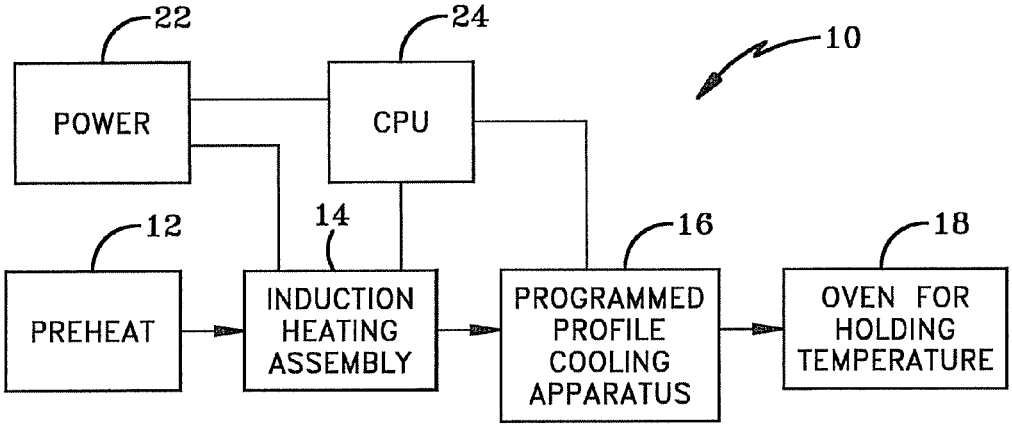
FIG. 1 is a diagrammatic view of the austempering apparatus of the present invention.

The austempering apparatus of the present invention is shown generally at 10 in FIG. 1. Apparatus 10 comprises a preheat chamber 12, an induction heating apparatus (IHA) 14, a programmed profile cooling apparatus (PPCA) 16, which may be integral with IHA 14, and an isothermal transformation chamber 18 in which a ductile iron part 20 (FIG. 2) remains as it undergoes the austempering process. While chamber 18 may be any suitable device for isothermal transformation of part 20, it is in one embodiment a special convection oven. Apparatus 10 further includes a source 22 of electrical power in electrical communication with the induction coil assembly of IHA 14. Source 22 or another source of power is in electrical communication with preheat chamber 12, sprayer 16 and isothermal transformation chamber 18 as well. Apparatus 10 includes a computer or central processing unit (CPU) 24 in electrical communication with source 22, IHA 14 and PPCA 16.

Figure 4:
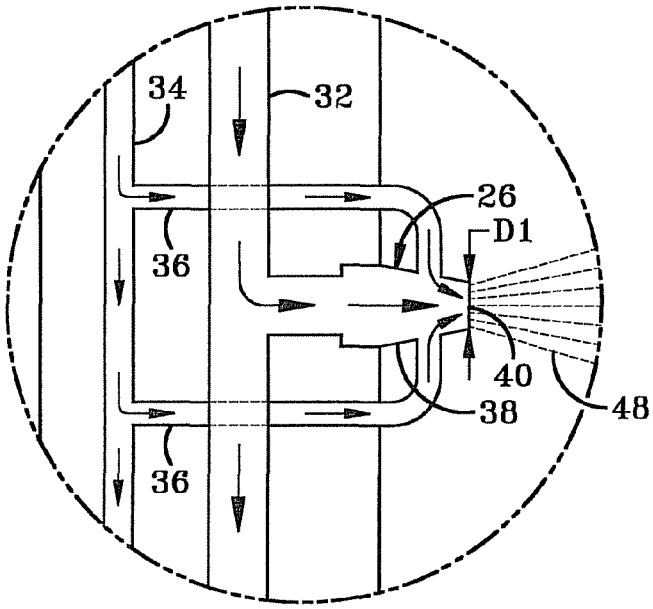
FIG. 4 is an enlarged view of the encircled portion of FIG. 2 showing the venturi nozzle of the sprayer.
Figure 2:
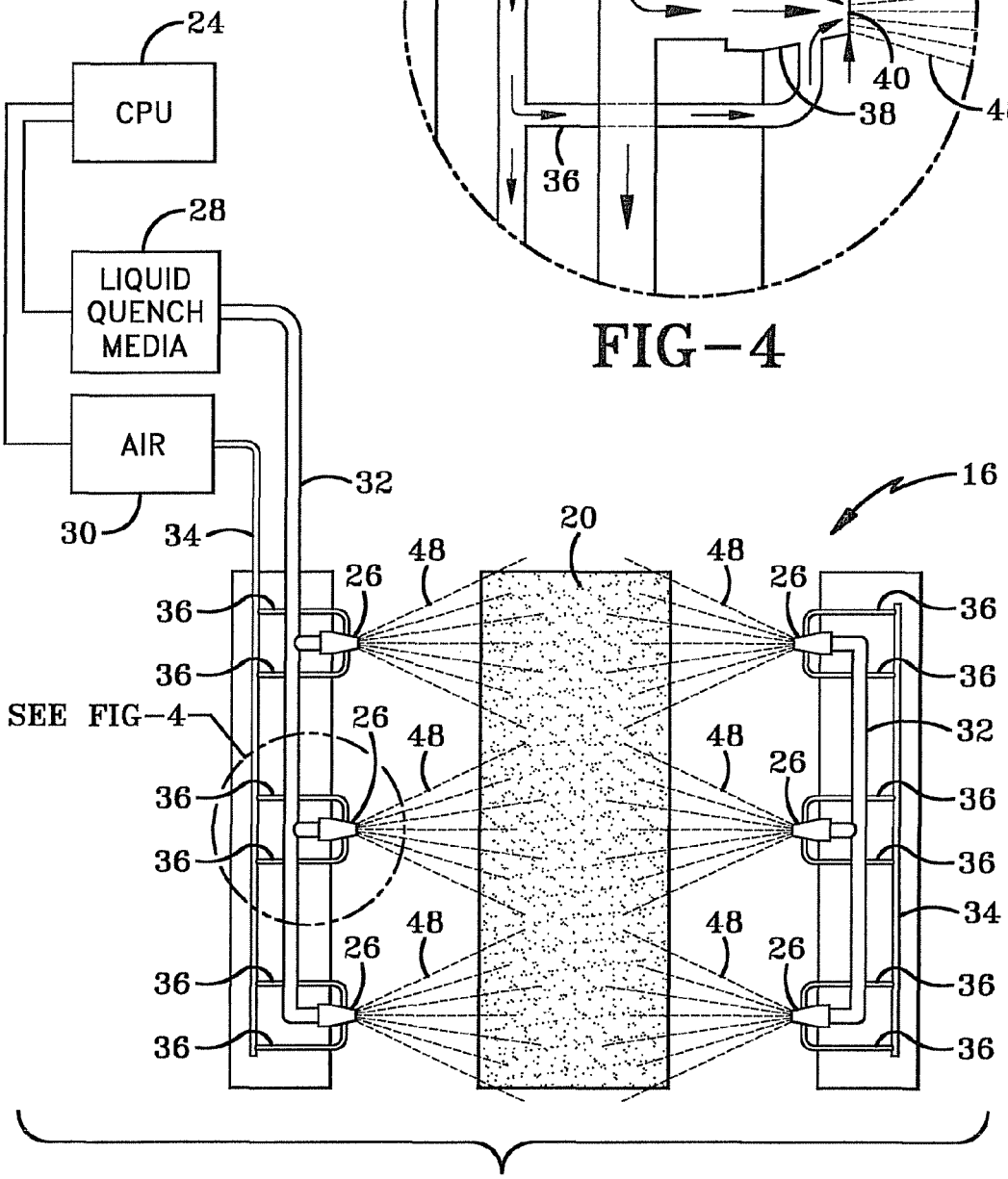
FIG. 2 is a diagrammatic view of the programmed profile cooling apparatus applying the required amount of quench cooling media to a part going through the austempering process and represents a relatively rapid rate of cooling.

Referring to FIG. 2, PPCA 16 includes a sprayer assembly having a plurality of venturi nozzles 26 in fluid communication with a source 28 of liquid quench media such as water or another typically aqueous solution and a source 30 of air or other inert gases. Source 28 may also include a polymer quenchant which is typically a water-based polymer mixture wherein the type and concentration of the polymer may vary in accordance with the specific application. Each of sources 28 and 30 include suitable pumps and control valves for respectively controlling the programmed profile of the flow of water and air or the like. Each of sources 28 and 30 is in electrical communication with CPU 24. A liquid or water feed line 32 communicates with source 28 and each of nozzles 26. A main air feed line 34 communicates with source 30 and a plurality of air feed branch lines 36 which communicate with respective nozzles 26. Referring to FIG. 4, each nozzle 26 typically includes a tapered chamber 38 which tapers inwardly and downstream to an orifice 40 or exit opening which has a specific diameter D1.

Before describing the operation of apparatus 10, the characteristics of part 20 prior to undergoing the process are discussed. Part 20 prior to beginning the austempering process may be referred to as an initial or untreated workpiece or part. Untreated part 20 may be a cast ductile iron material. It is noted that the present process may be used with an untreated part 20 formed of compacted graphite iron, ductile cast iron or gray cast iron without the addition of substantial, expensive alloy content. Thus, there is no need for commercially added alloys. The initial part is typically a primarily ferrous alloy which includes by weight greater than 1.0% carbon and greater than 1.0% of silicon. In most cases, the initial part includes by weight 90% or more of iron. The initial workpiece 20 may be formed free of or essentially free of alloying metals such as copper, nickel or molybdenum or any other metals. While the untreated workpiece may include such metals, it is generally preferred that such metals are kept to a minimum to minimize costs. Thus, the untreated part 20 typically includes by weight no more than 0.2% of copper, no more than 0.05% of nickel, no more than 0.01% of molybdenum, no more than 3.0% of any other metal other than iron, and no more than 4.0% of all metals combined other than iron. Prior to beginning the austempering process, untreated workpiece or part 20 preferably has a microstructure which is primarily ferritic rather than pearlitic (although a pearlitic structure is allowed by the process). Thus, the ratio of ferrite to pearlite is preferably greater than 1:1. Typically, the total percentage of pearlite in part 20 is in the range of about 3, 4 or 5 percent to 10, 15 or 20 percent. The total percentage of pearlite is typically no more than 5, 10, 15 or 20 percent although it may be greater as noted above. Thus, the preferred ratio of ferrite to pearlite is in the range of 4:1 to 19:1, 24:1 or about 32:1. Typically, the ferrite to pearlite ratio is in the range of 5:1 or 6:1 to 19:1, 20:1 or 24:1 and usually in the range 9:1 to 19:1 or 24:1, or in the range of 14:1 or 15:1 to 19:1 or 20:1. The listed percentages and ratios in this paragraph are not exhaustive, and Applicant thus intends that any percentages, ratios, or ranges thereof, especially within the ranges noted above may be recited in the claims. The use of such material having minimal alloying elements allows for a substantial reduction in initial material cost while also allowing for a high quality end product when using the method of the present invention.

The operation of apparatus 10 is now described with reference to FIGS. 1-5. Referring to FIG. 1, part 20 is usually placed in preheat chamber 12 and preheated preferably to a temperature above or near to the martensite formation temperature which is approximately 420° F. Thus, part 20 is typically preheated, for example, to a temperature of about 450° F. It is noted, however, that the degree of preheating is generally dependent upon the mass and geometry of the part so that if the portion of the part which is not to be austenitized (that is, the core of the part) is substantial enough, the part will be preheated whereas if that percentage is sufficiently low, preheating may be minimal or may be eliminated. Part 20 is then transferred into IHA 14 to be locally induction heated in a specific manner. Specific heating parameters are digitally controlled to tight tolerances by CPU 24 which is programmed to provide an energy input management system. Thus, CPU 24 controls power source 22 to provide a specific programmed power/energy envelope in concert with specific frequencies to provide the necessary thermal dynamics in accordance with a detailed heating profile which is suited to the various geometries and prior metallurgical characteristics of part 20. CPU 24 executes a heat transfer profile computer program to control operation of IHA 14.

Figure 6:
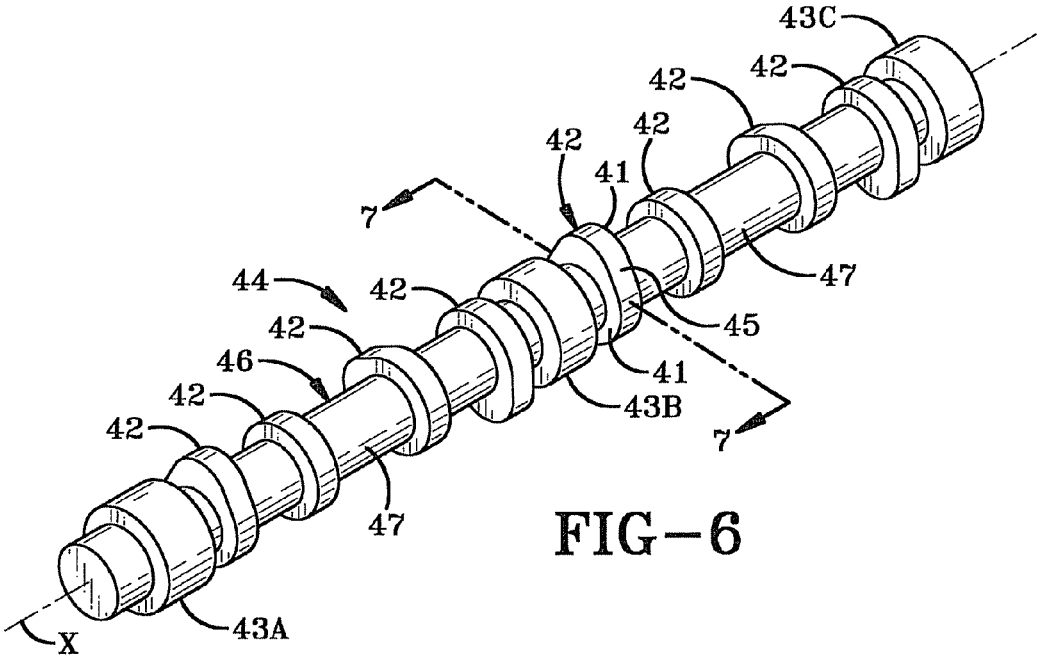
FIG. 6 is a perspective view of the camshaft showing its shaft, bearings and eccentric cam lobes.

The computer program and IHA 14 are particularly configured for selected localized heat treating of part 20. By way of example, localized induction heating may be applied to eccentric cam lobes 42 of a camshaft 44 (FIG. 6) although this localized heating technique is applicable to a wide range of part geometries, such as those mentioned in the Background section of the present application. Thus, a computer program is specifically developed for a given part geometry which is to undergo the austempering process of the present invention. A given computer program is largely based on simulation engineering analysis which makes use of computer modeling of a given part geometry to develop a thermal process control which includes a heat transfer profile for precisely controlling the pertinent processing parameters for heating and cooling the localized regions of the part. Additional details of the thermal process control are provided in the context of heating and cooling camshaft 44 to produce locally austempered ductile iron on lobes 42.

Camshaft 44 is formed as a rigid integral one-piece member and includes a substantially cylindrical longitudinal shaft 46 having a substantially cylindrical outer surface 47 concentric about a central longitudinal axis X. Camshaft 44 further includes lobes 42 and cylindrical bearings 43 rigidly secured to and extending radially outward therefrom. In the exemplary embodiment, there are three bearings 43A-C which are longitudinally spaced from one another with four of the lobes 42 between bearings 43A and 43B, and with four of the lobes 42 between bearings 43B and 43C. Each of the lobes 42 are longitudinally spaced from one another and from bearings 43. Each lobe 42 has opposed sides 41 which face away from each other, are typically parallel to one another, and extend radially outwardly from outer surface 47 of shaft 26 typically perpendicular to the longitudinal axis X of shaft 46. Each lobe 43 has an outer circumferential surface 45 which extends longitudinally from one side 41 to the other side 41 and circumferentially around axis X and shaft 46 in a continuous manner.

Figure 7:
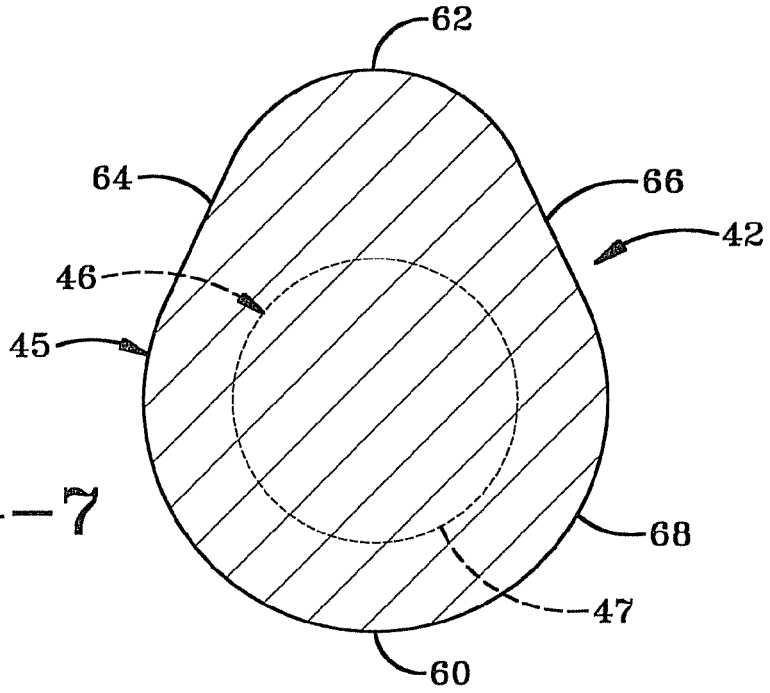
FIG. 7 is a sectional view taken on line 7-7 of FIG. 6 showing one of the eccentric lobes prior to the austempering process of the present invention.
Figure 8:
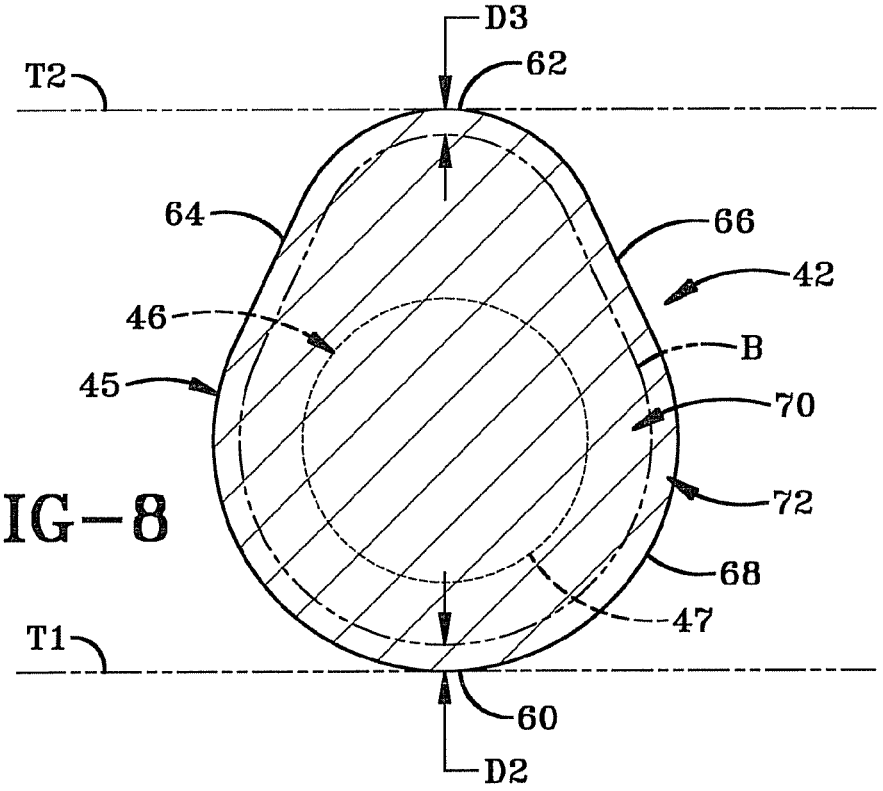
FIG. 8 is a sectional view similar to FIG. 7 showing one of the eccentric lobes after the austempering process of the present invention.

Surface 45 is generally egg-shaped or pear-shaped as viewed along the length of shaft 46 or along its longitudinal axis X. Lobe 42 thus has a generally egg-shaped or pear-shaped cross sectional shape, as shown in FIGS. 7-8. Outer circumferential surface 45 of lobe 42 has a convexly curved heel 60, a convexly curved nose 62 which is opposite heel 60 and further from axis X than is heel 60, a first ramp 64 and a second ramp 66 such that ramps 64 and 66 communicate with nose 62 on opposite sides thereof. Heel 60 lies along a generally semicircular portion 68 of outer surface 45 which is concentric about axis X. Ramps 64 and 66 communicate with semicircular portion 68 on opposite sides thereof. Ramps 64 and 66 in the exemplary embodiment are generally flat although they may also be convexly or concavely curved.

Thus, IHA 14 is configured to locally heat lobes 42 to the austenitizing temperature without deleterious heating of adjacent geometries of camshaft 44 to said temperature. Indeed, IHA 14 is configured to heat only a specified portion of lobes 42 to the austenitizing temperature, in particular to a specific controlled depth extending inwardly from the outer surfaces 45 of lobes 42. By controlling the profile of heat distribution, elevated temperatures can be achieved to a deeper depth within the component, thus producing a higher flatter temperature profile to said depth within the component without incipient melting. The process of the invention increases the amount of dissolved carbon in the austenite and thus results in increased hardenability and a reduced martensite start temperature during cooling. In many cases, the austenitizing temperature reaches a controlled desired depth of 3-5 millimeters without heating the remainder of camshaft 44 or other part to the austenitizing temperature. The austenitizing temperature can be achieved with similar results to a depth of 6-10 millimeters or more, and likewise so a shallower depth of 1 or 2 millimeters if desired. This controlled depth of heating is represented at depth D2 and depth D3 in FIG. 8, and is measured in the same manner as discussed further below with respect to the resultant ausferrite outer layer 72.

Figure 5A:
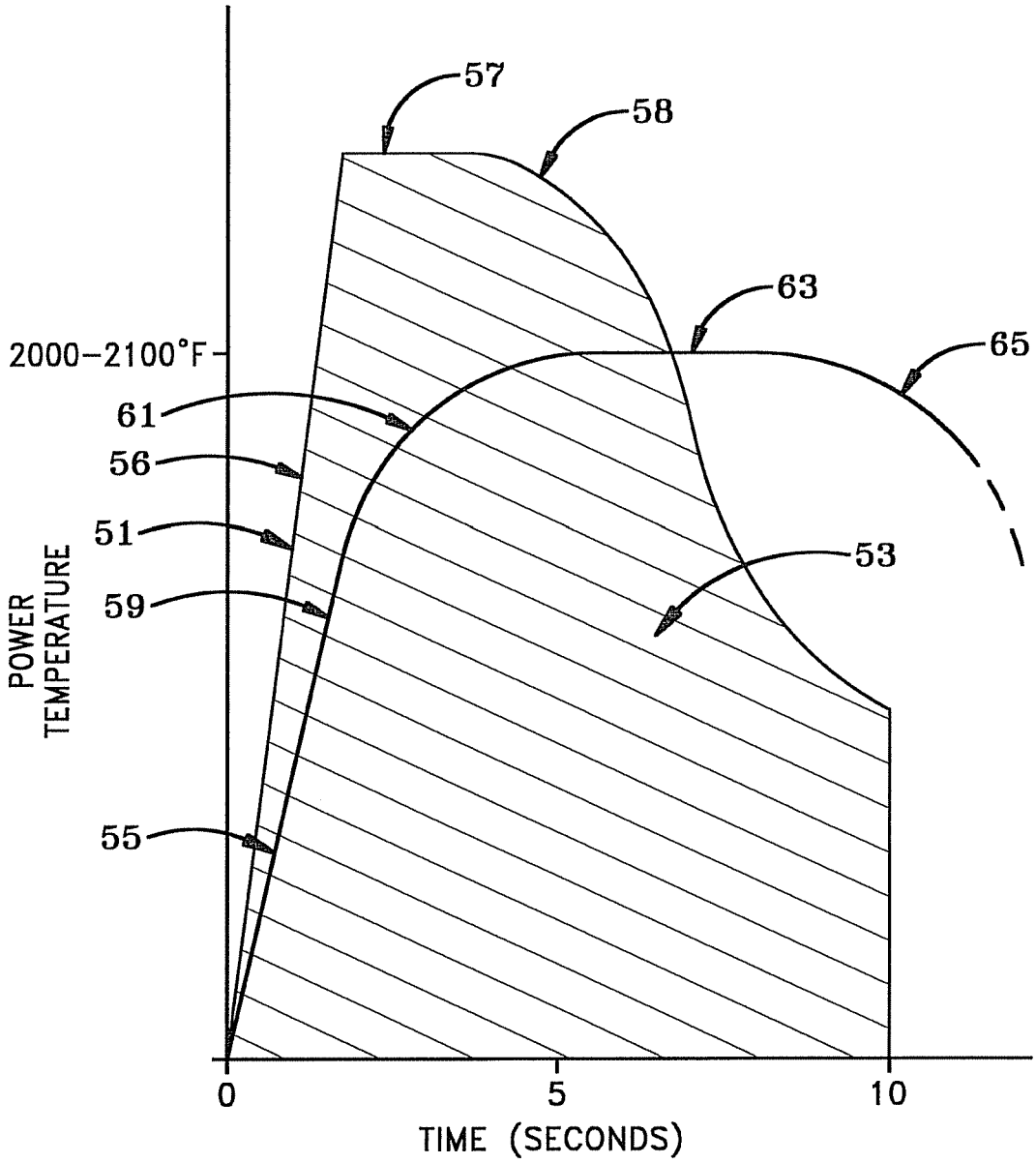
FIG. 5A is a time-energy and time-temperature diagram showing the programmed profile heating of the localized areas along the outer surface of a camshaft.

Austenitizing temperatures are typically in the range of about 1420° to 2100° F. although they may exceed 2100° F. in the present process. In the present method, the localized regions of part 20/lobes 42 are typically heated to an austenitizing temperature of 2000° F. or higher. Depending on the specific power used (kilowatts), the heating time to reach the austenitizing temperature typically ranges from 1 to 20 seconds although this may vary. The localized portion of part 20 is heated very rapidly to an elevated austenitizing temperature which is purposely programmed to be just below the melting temperature of part 20, as illustrated in FIG. 5A, which shows graphically a power input or applied energy profile 51 defining an energy envelope 53 shown by the hatched lines under profile 51. Application of power in accordance with profile 51 causes the induction coil or coils of IHA 14 to electromagnetically couple with the lobes 42 along outer surfaces 45 to inductively heat the desired localized regions thereof wherein the temperature of the localized regions is represented at 55.

FIG. 5A shows that profile 51 includes an initial or first stage very rapid maximum power up ramp 56, a second stage power plateau 57 immediately following up ramp 56 and a third stage power reduction profile immediately following plateau 57. FIG. 5A also shows that localized region temperature 55 includes an initial or first stage rapid temperature increase 59, a second stage slower temperature increase 61 which asymptotically approaches a predetermined maximum temperature limit (shown here as 2000 to 2100° F.) to reach a third stage maximum temperature at flat plateau 63 followed by a fourth stage temperature reduction 65.

CPU 24 is programmed with a precisely digitally controlled power profile to use a high initial power to accelerate the heating of the localized area to the elevated austenitizing temperature and subsequently to decrease the power as a second order mathematical control function to hold the localized region at this temperature for the required time interval. In the exemplary embodiment, up ramp 56 represents this high initial power to heat the localized regions of the part from an ambient temperature (or a preheated temperature if applicable) very rapidly (first stage 59). As the heated region approaches the predetermined maximum temperature 63, the computer program controls power source 22 to apply the level energy input at second stage 57 so that the temperature approaches the maximum temperature limit asymptotically and reaches the predetermined localized region maximum temperature 63. In the exemplary embodiment, the localized layer 72 reaches maximum temperature 63 within about 5 seconds and is held at temperature 63 for only a few seconds on the order of about 5 seconds in duration. Typically, the localized region is held at an elevated austenitizing temperature which is within 100° F. of and below the melting temperature of the localized region and preferably within 90° F., 80° F., 70° F., 60° F. or 50° F. of and below the melting temperature of the localized region. The prior art systems known to the Applicants are not capable of heating a localized region of a part to such an elevated austenitizing temperature nor holding it there without incipient melting of the localized region, especially at temperatures of 2000° F. or higher.

Due to the ability of the present system to heat the localized regions to such elevated austenitizing temperatures, the localized region may be held for a much shorter duration at said temperature than in known prior systems. For example, using the present method, the localized regions of lobes 42 of camshaft 44 are held at the elevated austenitizing temperature typically for only about 5 to 10 seconds, typically at a temperature of 2000° F. or higher. In contrast, prior art systems typically heat the localized region to a temperature in the range of about 1550° F. to 1700° F. Electromagnetic induction heating provides for very rapid and well controlled localized heating. However, other forms of applied high energy heating systems may be used, such as laser, high intensity light, electron beam and so forth. These other forms are typically used in conjunction with an infrared temperature feedback loop. The heating profile computer program executed by CPU 24 is configured to apply energy in a manner which accelerates carbon migration in the shortest time possible without incipient melting within reasonable time increments to produce the required carbon saturation levels at the required depth of the localized area. The rate of carbon diffusion increases proportionally to the square of the differential increase in temperature, whereby the present process of achieving higher austenitizing temperatures without incipient melting is able to greatly increase the rate of the austenitizing process and likewise greatly increase the resultant carbon in the austenite. The current process also substantially reduces the energy required to complete the austenitizing stage. After heating to the austenitizing temperature, a short delay time is typically provided to allow thermal homogenization within the localized area. Typically, this is no more than 60 seconds and preferably no more than 10 seconds.

Once the austenitizing temperature is reached and after any delay time, the part must be cooled at a sufficient rate to avoid the formation of pearlite to a temperature below the pearlite nose, which varies with the chemistry of the iron. As previously noted, once the temperature moves below the pearlite nose, it must be maintained above the martensite formation temperature to prevent the formation of martensite. In accordance with the invention, the energy input management program or heat transfer program executed by CPU 24 includes a tightly controlled cooling profile to optimize the initiation of ausferrite formation. Most preferably, the austenitized portion of the part should cool from the austenitizing temperature to below the pearlite nose within 15 seconds, although this time period may vary, to avoid formation of pearlite in the localized regions. Preferably, this rapid quench period is achieved within 20 or 25 seconds. However, depending on various circumstances, the quench time may extend up to 180 seconds.

Figure 5B:
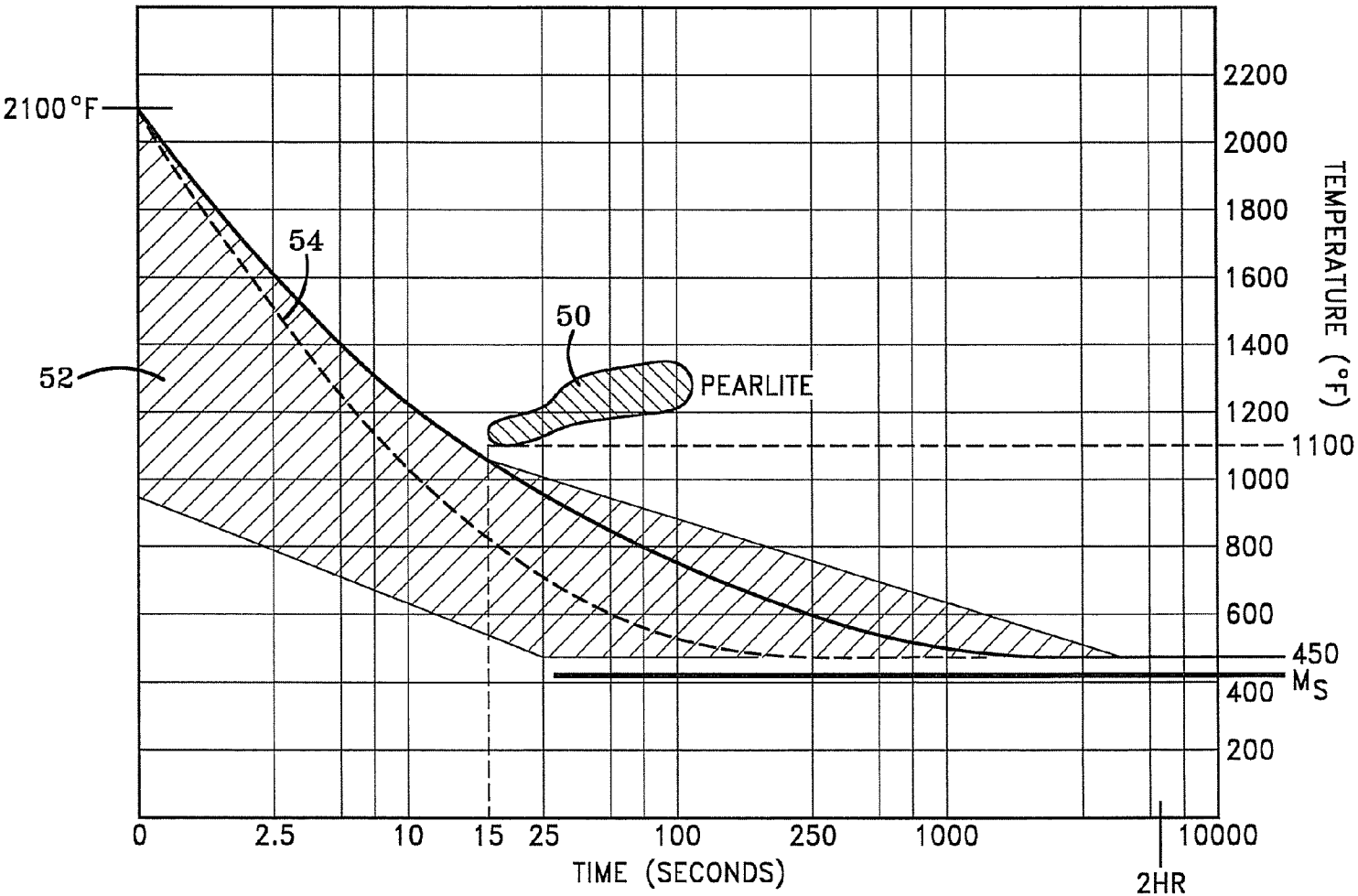
FIG. 5B is a time-temperature diagram showing the programmed profile cooling of the locally austempered areas on the camshaft.

Once below the pearlite nose temperature, cooling rates are substantially slowed. For a component requiring a high hardness, ausferritic surface, the cooling rate curve asymptotically approaches a temperature near, but not below, the martensite start temperature ($M_s$) or resultant $M_s$ based on additional diffused carbon levels generated to provide a more stable and reliable process. Broadly, the austempering temperature ranges from 450° to 750° F. However, the high austenitizing temperature and the tightly controlled cooling process of the present invention allows for a minimum temperature of 400° F. or below while staying above the estimated martensite formation temperature. FIG. 5B shows a time-temperature diagram of a cooling profile used with a camshaft such as that shown in FIG. 6 in which the eccentric cams or lobes were locally heated to an austenitizing temperature of approximately 2100° F. More specifically, the diagram shows the cooling profile used for cooling the austenitized portions of the camshaft so that the rapid quenching occurs within 15 seconds and the subsequent slower cooling rate proceeds asymptotically toward a temperature of 450° F. The diagram shows the martensite formation temperature at $M_s$. The diagram also shows a pearlite formation region 50, an allowed cooling range 52 and the specific profile used with the camshaft at the dashed line 54 within region 52. In particular, the camshaft used was formed of an ASTM 65-45-12 ferritic material in which the cam lobes were heated to the austenitizing temperature and cooled in accordance with the cooling profile of the diagram. The cam lobes had a width of 0.650 inches and a circumferential length of 6.06 inches. The cam lobes were heated to a depth of about 4.5 millimeters to the austenitizing temperature and upon completing the cooling profile formed in the localized region a substantially ausferritic microstructure to about the same depth.

Figure 3:
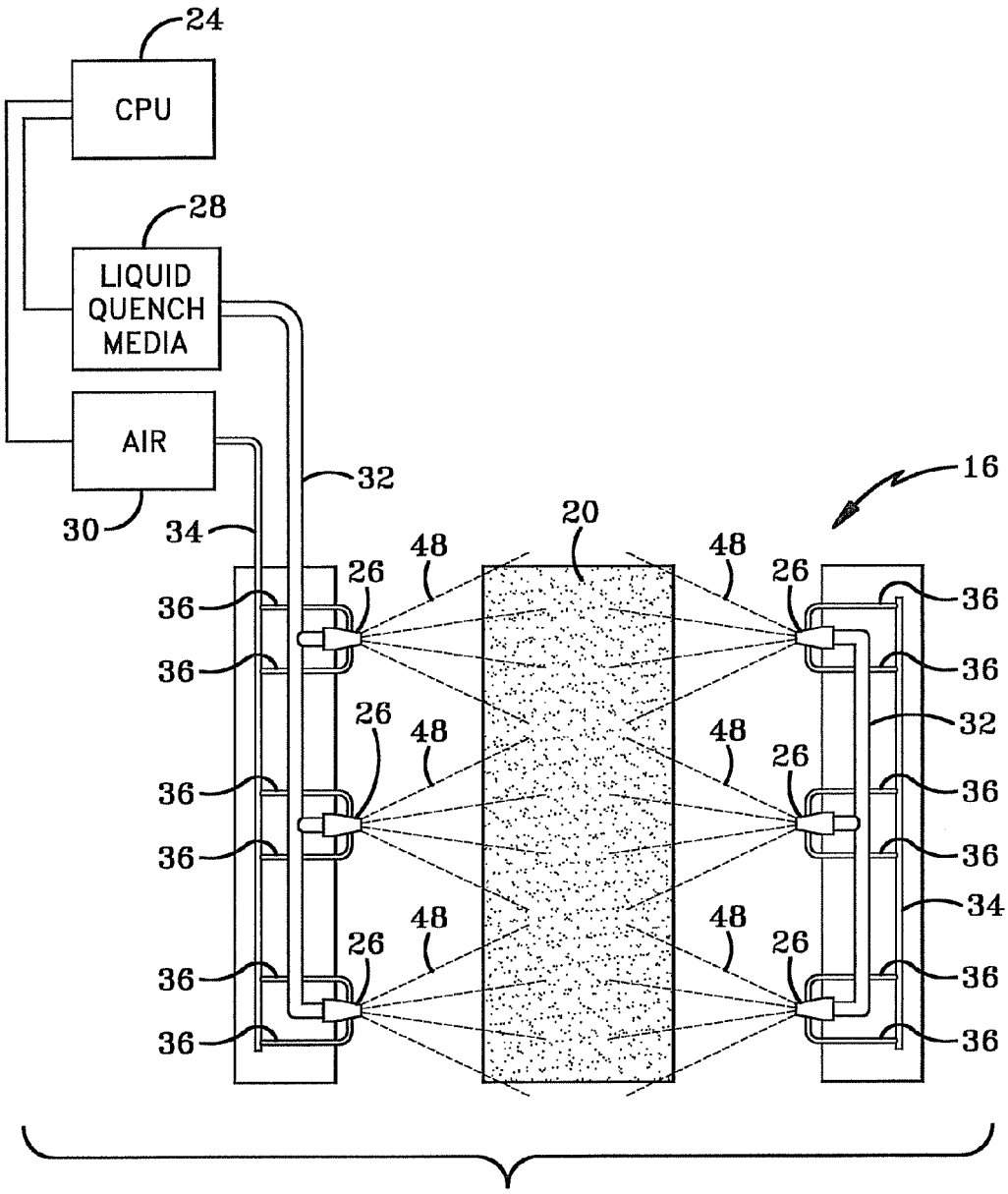
FIG. 3 is similar to FIG. 2 and shows a subsequent application of the quench media to the part representing a relatively slower rate of cooling.

In order to achieve this highly controlled cooling process, CPU 24 controls PPCA 16 in a predetermined manner in accordance with the heat transfer profile program. CPU 24 thus controls the rate of flow of the water or other source of liquid quench media from source 28 to nozzles 26 as well as the rate of air or other inert gases from source 30 to nozzles 26. The specific orifice diameter D1 of the venturi nozzle 26 combined with a predetermined flow of air creates a mist or spray of a mixture of the liquid quench media and air or other gas which when applied to part 20 substantially facilitates control of the cooling rate. The quenching stage of the cooling process is shown in FIG. 2 in which the mist or spray of quench media 48 is applied at a relatively high rate to provide cooling coefficients suitable for dropping the austenitized portions of part 20 from the austenitizing temperature to below the pearlite nose within the 15-second (or other) interval previously noted. Subsequently, as shown in FIG. 3, CPU 24 controls the flow of air and water to produce a reduced rate of flow of quench media 48 in order to provide the reduced cooling rates below the pearlite nose for approaching a holding temperature or temperature range above the martensite formation temperature. Once a desired temperature is reached, part 20 may be moved to convection oven 18 to maintain the austempering temperature for a desired time interval detailed below. CPU 24 is programmed to closely control these rates in order to provide the specified cooling profile. The rapid quenching system and method using the above-noted mist or spray is highly controlled to provide optimal results and avoids the use a liquid bath such as a salt bath or oil bath in which parts are immersed for quenching, as discussed in the Background section above.

As previously noted, the austempering temperature in the prior art ranges from 450° to 750° F. and most typically in the range of 450° to 500° F. Part 20 may be held at the austempering or holding temperature or temperature range for a period between 10 minutes to 240 minutes, as has been done in the prior art. However, the tightly controlled temperature profile of the present invention allows for the use of a minimum temperature of, for example, 400 to 449° F. (or any temperature within that range) and a holding time in excess of 241 minutes to complete the desired ausferritic reaction. Thus, the present method allows for the use of a lower austempering temperature than that of known prior art methods. In addition, the use of extended holding times beyond 4 hours, that is 240 minutes, has previously been seen as an excessive austempering time which results in the decomposition of ausferrite into bainite, that is, into acicular ferrite and carbide. The higher matrix carbon level induced by this process favorably alters those kinetics so that the time required is greatly increased, thus increasing the process window. The use of convection oven 18 to hold the part at the austempering temperature thus provides a non-liquid temperature holding device and thus avoids the use of a liquid bath, which greatly simplifies the process.

Most preferably, the resulting product is a final or treated workpiece or part 20 which, as illustrated in FIG. 8 and represented by camshaft 44, has a core or base 70 formed of ferritic (or pearlitic or ferritic/pearlitic) material—which is the same as the original material of the untreated part (FIG. 7) prior to treatment according to the process of the present invention—with localized layers of ausferrite. More particularly, FIG. 8 shows a cross section of one of eccentric lobes 42 illustrating base 70 and a circumferential outer layer 72 which meet at a boundary B. The locally austempered end product (FIG. 8) has the same gross configuration or overall physical structure as viewed by the naked eye as the initial untreated workpiece (FIG. 7) while the internal microstructure of outer layer 72 has changed. Outer surface 45 serves as the outer boundary of layer 72 while boundary B serves as its inner boundary. Boundary B thus also serves as the outer boundary of base 70 whereby essentially all of the material of lobe 42 within boundary B is formed of the material described above, which is a non-ausferritic material.

Outer layer 72 typically has a depth D2 or D3 of 3 to 5 millimeters and more preferably 4 to 5 millimeters or more. In keeping with the previously noted ability to control the austenitizing temperature to a depth of 3-10 millimeters or more from the outer surface 45 of a part without incipient melting and essentially without heating the remainder of the part (including base 70) to the austenitizing temperature, the localized surface layers of ausferrite may be formed to the same depth whereby depth D2 and D3 may be 3, 4, 5, 6, 7, 8, 9 or 10 millimeters or more. While depth D2 and D3 may be only 1 or 2 millimeters, a depth of 3 millimeters or more is usually preferred. Depth D2 is shown at heel 60 while depth D3 is shown at nose 62. Depth D3 and depth D2 may be the same although depth D3 is typically somewhat greater than depth D2 due to the nature of the configuration of lobe 42 whereby heating to the austenitizing temperature extends to somewhat greater depth at nose 62 than at heel 60. Depth D2 and D3 are defined more particularly as the depth or distance from outer surface 45 to boundary B as measured from outer surface 45 at the intersection with a tangent thereof perpendicular to the tangent. Thus, depth D2 is measured from the intersection of tangent T1 and outer surface 45 at heel 60 and depth D3 is measured from the intersection of tangent T2 and outer surface 45 at nose 62. The depth of outer layer 72 measured from any point along outer surface 45 is likewise within the ranges given for depth D2 and D3 and thus is fairly consistent or substantially uniform all the way around outer surface 45 of the non-concentric lobe. The final product thus includes base 70 and outer layer 72 such that the inner boundary B of outer layer 72 is coincident with and rigidly connected to the outer boundary B of base 70 with outer layer 72 extending outwardly therefrom to outer surface 45.

Most preferably, the localized region or outer layer 72 has a substantially, and preferably completely, ausferritic microstructure. However, these regions or outer layers 72 may include some bainite or martensite although this is typically a very small percentage. The formation of a metallic matrix which is substantially ausferrite is typically preferred in that it is able to sustain higher Hertzian contact stress loads and abrasion than martensite, ferrite, pearlite or bainite. The austempered microstructure of outer layer 72 is by volume preferably at least 80% ausferrite, more preferably at least 85%, 90% or 95% ausferrite, and more preferably 96%, 97%, 98%, 99% or 100% ausferrite.

Thus, apparatus 10 provides for various capabilities within the austempering process which can use a broad thermal range to handle an expanded range of readily available lower cost starting materials. In particular, the flexibility of the electromagnetic induction heating system helps to optimize the resultant metallurgical reactions to provide locally austempered parts having improved performance characteristics. The method allows for the treatment of a wider range of part design geometries and generally is more energy efficient and cost effective than known prior art methods. In addition, while the process of the present invention for producing locally austempered ductile iron (austenitizing and austempering only the outer surface layer to a controlled depth) may be applied to an untreated iron workpiece which has a primarily pearlitic rather than ferritic microstructure (ratio of pearlite to ferrite is greater than 1:1), the process of the invention advantageously allows the untreated iron workpiece to be primarily ferritic rather than pearlitic (as discussed in greater detail further above), which has traditionally been impossible, the traditional process requiring that the untreated workpiece have a primarily pearlitic rather than ferritic microstructure. Further, the present method does not require that the initial workpiece be formed of a relatively high cost alloy comprising the alloying metals previously discussed. Furthermore, eliminating or substantially eliminating those alloys not only reduces the price of the casting, but also improves the machinability of the non-austempered areas of the casting.

In the foregoing description, certain terms have been used for brevity, clearness and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A method comprising the steps of:

providing a heat transfer profile computer program which is based on simulation engineering analysis which makes use of computer modeling of a given part geometry to develop a thermal process control which includes a heat transfer profile for precisely controlling pertinent processing parameters for heating a localized region of a ductile iron part having the given part geometry; and controlling a heating device with the program to heat the localized region of the ductile iron part to an austenitizing temperature.

2. The method of claim 1 wherein the step of controlling comprises the step of controlling electric power applied to the heating device to provide a first stage of rapid power increase followed by a second stage in which the power is decreased in accordance with a second order mathematical function.

3. The method of claim 1 wherein the step of controlling comprises the step of controlling the heating device with the program to maintain the localized region at an austenitizing temperature which is below and within 100° F. of an incipient melting temperature of the localized region.

4. The method of claim 1 further comprising the step of cooling the localized region from the austenitizing temperature to an austempering temperature to form ausferrite in the localized region.

5. The method of claim 4 wherein the step of cooling comprises the step of cooling the localized region in accordance with the computer program from the austenitizing temperature to the austempering temperature to form ausferrite in the localized region.

6. The method of claim 5 wherein the step of cooling comprises the step of cooling the localized region in accordance with the computer program from the austenitizing temperature at a rate sufficient to avoid the formation of pearlite to a temperature above martensite formation temperature.

7. The method of claim 6 further comprising the step of holding the temperature of the localized region in accordance with the computer program at the temperature above martensite formation temperature for a time suitable to allow for the formation of ausferrite in the localized region.

8. The method of claim 7 wherein the step of holding comprises the step of holding the temperature of the localized region within a range of 400 to 449° F.

9. The method of claim 4 wherein the step of cooling comprises the step of spraying a liquid quench medium on the part.

10. The method of claim 9 wherein the step of spraying comprises the steps of moving a mixture of the liquid quench medium and a gas through a spray nozzle to create a spray; and directing the spray toward the part.

11. The method of claim 4 wherein the localized region comprises by volume at least 80% ausferrite.

12. The method of claim 11 wherein the localized region comprises by volume at least 85% ausferrite.

13. The method of claim 12 wherein the localized region comprises by volume at least 90% ausferrite.

14. The method of claim 11 wherein the ductile iron part prior to the step of controlling has a microstructure having a ratio of ferrite to pearlite greater than 1:1.

15. The method of claim 4 wherein the ductile iron part prior to the step of controlling has a microstructure having a ratio of ferrite to pearlite greater than 1:1.

16. The method of claim 15 wherein the ratio of ferrite to pearlite is at least 4:1.

17. The method of claim 4 wherein the steps of providing, controlling and cooling result in transforming the ductile iron part into a transformed part comprising a base formed of one of ferritic iron, ferritic/pearlitic iron and pearlitic iron, with the localized region serving as a localized outer layer of ausferrite on the base.

18. The method of claim 17 wherein the localized outer layer of ausferrite has a depth of at least 3.0 millimeters.

19. The method of claim 18 wherein the depth is at least 4.0 millimeters.

20. The method of claim 19 wherein the depth is at least 5.0 millimeters.

21. The method of claim 3 wherein the austenitizing temperature is at least 2000° F.

22. The method of claim 21 further comprising the step of cooling the localized region from the austenitizing temperature to an austempering temperature to form ausferrite in the localized region so that the localized region comprises by volume at least 80% ausferrite;

wherein the ductile iron part prior to the step of controlling has a microstructure having a ratio of ferrite to pearlite greater than 1:1; and the steps of providing, controlling and cooling result in transforming the ductile iron part into a transformed part comprising a base with a microstructure having a ratio of ferrite to pearlite greater than 1:1, with the localized region serving as a localized outer layer of ausferrite on the base.

23. The method of claim 22 wherein the localized region comprises by volume at least 95% ausferrite.

24. The method of claim 23 wherein the ratio of ferrite to pearlite of the ductile iron part prior to the step of controlling is at least 4:1; and the ratio of ferrite to pearlite of the base is at least 4:1.

25. The method of claim 21 wherein the austenitizing temperature is below and within 60° F. of the incipient melting temperature of the localized region.

26. The method of claim 9 wherein the step of cooling comprises the step of controlling a sprayer assembly with the computer program to spray the liquid quench medium on the part at a first rate; and subsequently controlling the sprayer assembly with the computer program to spray the liquid quench medium on the part at a second reduced rate.

27. The method of claim 13 wherein the localized region comprises by volume at least 95% ausferrite.

28. The method of claim 14 wherein the steps of providing, controlling and cooling result in transforming the ductile iron part into a transformed part comprising a base with a microstructure having a ratio of ferrite to pearlite greater than 1:1, with the localized region serving as a localized outer layer of ausferrite on the base.

29. The method of claim 28 wherein the step of controlling comprises the step of controlling the heating device with the program to maintain the localized region at an austenitizing temperature which is below and within 100° F. of an incipient melting temperature of the localized region.

30. The method of claim 29 wherein the localized region comprises by volume at least 95% ausferrite.

31. The method of claim 30 wherein the ratio of ferrite to pearlite of the ductile iron part prior to the step of controlling is at least 4:1; and the ratio of ferrite to pearlite of the base is at least 4:1.

32. The method of claim 3 wherein the austenitizing temperature exceeds 210020 F.

33. The method of claim 32 wherein the austenitizing temperature is below and within 60° F. of the incipient melting temperature of the localized region.

* * * * *

UNITED STATES PATENT AND TRADEMARK OFFICE

CERTIFICATE OF CORRECTION

PATENT NO. : 8,372,222 B2
APPLICATION NO. : 12/572828
DATED : February 12, 2013
INVENTOR(S) : George D. Pfaffmann It is certified that error appears in the above-identified patent and that said Letters Patent is hereby corrected as shown below:

In the Claims:

Column 12, line 25 (Claim 32) "210020 F" should be changed to --2100°F--

Signed and Sealed this
Eleventh Day of June, 2013

Teresa Stanek Rea
*Acting Director of the United States Patent and Trademark Office*

UNITED STATES PATENT AND TRADEMARK OFFICE
Certificate

Patent No. 8,372,222 B2 Patented: February 12, 2013

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: George D. Pfaffmann, Farmington Hills, MI (US); John R. Keough, Ann Arbor, MI (US); Robert J. Madeira, Commerce Township, MI (US); Christopher Allen Bixler, Ypsilanti, MI (US); and Kathy L. Hayrynen, Ypsilanti, MI (US).

Signed and Sealed this Twenty-fifth Day of November 2014.

ROY V. KING
*Supervisory Patent Examiner*
Art Unit 1733
Technology Center 1700